United States Patent [19]

Ohtani et al.

[11] 4,259,551

[45] Mar. 31, 1981

[54] EXTERNAL OPERATION DEVICE FOR ELECTRONIC TIMEPIECES

[75] Inventors: Akinobu Ohtani; Hideo Hatanaka, both of Higashimurayama; Motoyuki Saito, Higashiyamato, all of Japan

[73] Assignee: Citizen Watch Co., Ltd., Tokyo, Japan

[21] Appl. No.: 20,481

[22] Filed: Mar. 14, 1979

[30] Foreign Application Priority Data

Mar. 15, 1978 [JP] Japan ..... 53/29648
Aug. 22, 1978 [JP] Japan ..... 53/114276[U]

[51] Int. Cl.[3] ..... H01H 9/26; H01H 9/04; H01H 13/06

[52] U.S. Cl. ..... 200/5 A; 200/52R; 200/302; 368/278; 368/291

[58] Field of Search ..... 200/5 A, 52 R, 302

[56] References Cited

U.S. PATENT DOCUMENTS

| | | | |
|---|---|---|---|
| 3,699,294 | 10/1972 | **Sudduth** | 200/86 R X |
| 3,860,771 | 1/1975 | **Lynn et al.** | 200/5 A |
| 3,898,421 | 8/1975 | **Suzumura** | 200/5 A X |
| 4,046,975 | 9/1977 | **Seeger, Jr.** | 200/5 A |
| 4,066,851 | 1/1978 | **White et al.** | 200/86 R X |
| 4,163,125 | 7/1979 | **Boulanger** | 200/302 X |
| 4,207,443 | 6/1980 | **Matsuura** | 200/5 A |

FOREIGN PATENT DOCUMENTS

| | | | |
|---|---|---|---|
| 2268342 | 11/1975 | France | 200/5 A |

*Primary Examiner*—J. V. Truhe
*Assistant Examiner*—Richard M. Moose
*Attorney, Agent, or Firm*—Bernard & Brown

[57] ABSTRACT

An external operation device for electronic timepieces having a switch unit made up of an array of a plurality of electric switches is inserted in an external member of a timepiece and said electric switches being electrically connected to an internal module.

13 Claims, 20 Drawing Figures

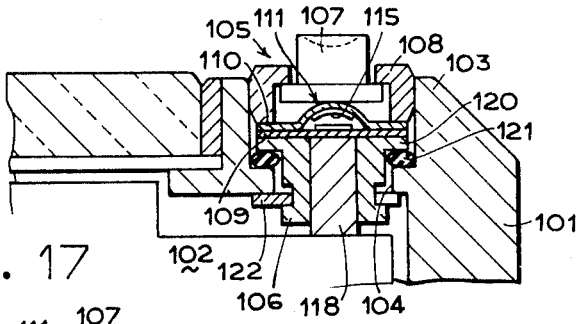
FIG. 17
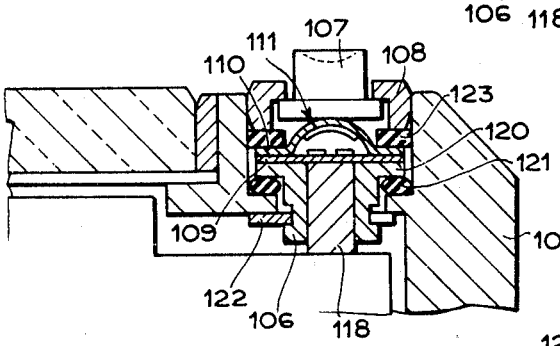
FIG. 18
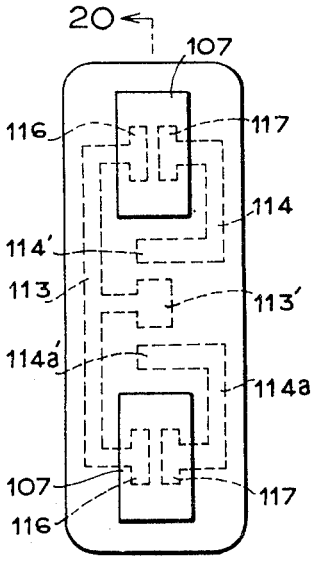
FIG. 19
FIG. 20
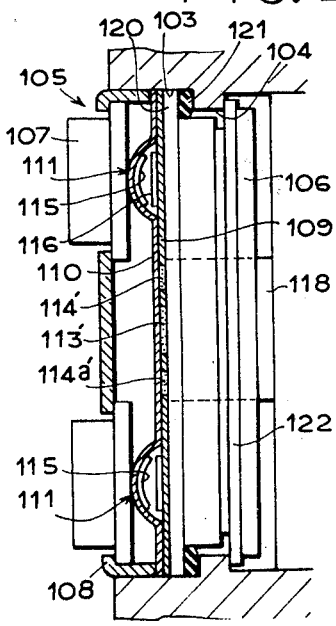

EXTERNAL OPERATION DEVICE FOR ELECTRONIC TIMEPIECES

BACKGROUND OF THE INVENTION

1. Field of the Invention

This invention relates to an external operation device for electronic timepiece, particularly to a device in which a plurality of electric switches are integrated into a unit.

2. Description of the Prior Art

The electronic timepieces using a quartz crystal as a source of oscillation are rapidly progressing in recent several years. Particularly, the electronic timepieces of the type of liquid crystal display are offering displays of various functions that were impossible with the conventional mechanical timepieces, enabling the timepieces to find extensive applications.

The development of electronic timepieces of the type of liquid crystal display, however, has also resulted in the increase of the number of external operation devices that must be fitted to each of the electronic timepieces, presenting great burden to the job of the department in charge of the production of external members, to the job of the technical department and even to the job of the design department.

Push-button switches for electronic wrist watches must be simple in construction and small in size. According to the conventional switches, a resilient base plate is folded in a U-shape, electrodes are provided on the opposing surfaces of the base plate, and the resilient base plate is pressed by a push button so that the opposing electrodes come into pressed contact with each other thereby to close the switch. With the switches of such a type, however, the radius of curvature of a folded portion of the resilient base plate must be selected to be great to some extent in order for the folded portion to produce sufficient force or restoration, presenting such a defect that the stroke of the push button tends to be increased in a pushing direction.

SUMMARY OF THE INVENTION

It is a general object of this invention to provide an improved external operation device for an electronic timepiece in which the defects of the conventional devices set forth above are effectively eliminated.

It is another object of this invention to provide a useful device with a switch unit which makes it possible to assemble the device in ease.

It is another object of this invention to provide a device which enables an electronic timepiece to be low in its cost and good in its appearance.

It is still another object of this invention to provide a device which is excellent in its waterproof structure.

It is a further object of this invention to provide a device which can make the thickness of a switch thin and which is elevated in its reliability.

According to one aspect of this invention there is provided an external operation device for electronic timepieces characterized in that a switch unit made up of an array of a plurality of electric switches is inserted in an external member of a timepiece, and said electric switches are electrically connected to an internal module.

The features of this invention which are believed to be novel are set forth with particularity in the appended claims. The present invention, both as to its organization and the mannner of its operation, together with further objects and advantages thereof, may be understood best by reference to the following description, taken in connection with the accompanying drawings.

BRIEF DESCRIPTION OF THE DRAWINGS

FIG. 17 is a cross-sectional view in part showing the other embodiment according to this invention;

FIG. 18 is a cross-sectional view in part showing another embodiment of this invention;

FIG. 19 is a plan view of an electricity distribution panel showing another embodiment according to this invention; and FIG. 20 is a cross-sectional view of FIG. 19.

DETAILED DESCRIPTION OF THE INVENTION

Figure 1:
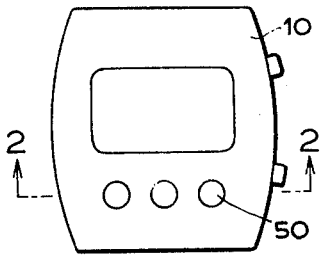
FIG. 1 is a plan view of the conventional electronic watches.
Figure 2:
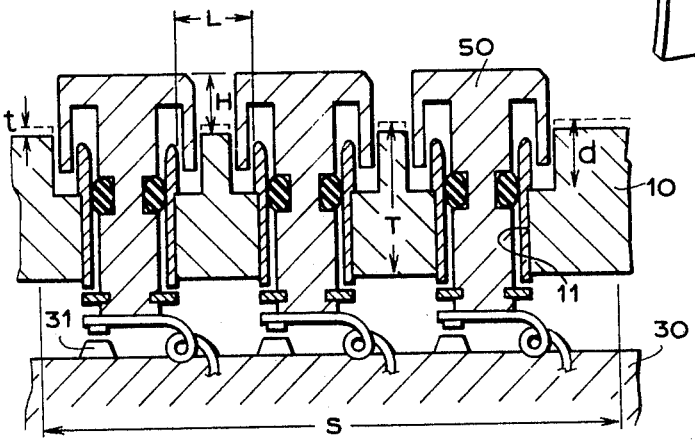
FIG. 2 is a cross-sectional view along a line 2—2 of FIG. 1.

FIGS. 1 and 2 show the prior art device, for instance, when a plurality of push buttons 50 were to be provided on the upper surface of a timepiece case 10, holes 11 had to be formed maintaining high degree of precision. Besides, since a distance L was short between the neighboring holes 11, it was difficult to form the holes by means of a multispindle drill, thus requiring great effort for forming the holes. In particular, when the timepiece case 10 was made of a hard material, the holes had to be formed with progressively increased effort.

In regard to the polishing operation, the upper surfaces of the timepiece cases 10 are almost all finished by polishing in order to heighten the commercial value. Due to the nature of the polishing operation, however, the polished amount t is often varied, causing the height H of the push buttoms 50 protruded beyond the upper surface of the timepiece case 10 to become uneven. Therefore, the upper surfaces of the timepiece cases are usually polished by skilled workers. Besides, although the upper surface of the timepiece case 10 has been formed by the pressing by means of an upper metal mold and a lower metal mold in order to maintain the thickness T contant, the dispersion in pressing operation often causes the thickness T to become nonuniform inducing dispersion in the depth d of facing after the holes have been formed.

Thus, since the abovementioned problems are of a nature that appears in the final step of machining, a lot of money and time are necessary to cope with the thus developed problems.

From the technical standpoint, a wide contact space S must be provided in the timepiece case 10 and in a module 30 such that each of the push buttons 50 is allowed to come into contact with contact points 31 of the module 30 as shown in FIG. 2. This, however, gives a serious problem when there are many contact points 31 such as in a timepiece equipped with a calculator. For example, in the case of a timepiece equipped with a calculator employing a push-button construction as shown in FIG. 2, the push buttons 50 each of which requiring an area of about 1 $cm^2$ can be arrayed in a number of ten at the greatest on the upper surface of the timepiece case 10. Accordingly, the timepiece equipped with a calculator employing the push-button construction shown in FIG. 2, has not yet been materialized. If a required number of push buttons were arrayed, the whole size of the timepiece case will become tremendously great; aesthetic elements of the timepiece case will be extinguished quite losing the sales appeal. Even in regard to the module, the contact points 31 will occupy increased space making it difficult to design the module.

From the viewpoint of appearance, the push buttons which must be shaped round due to the machining requirements, are not capable of giving accent to the sense of aesthetics of the timepiece cases. Moreover, the appearance is determined depending upon the locations of contact points of the module, thus restricting the freedom in designing the appearance.

This invention was contrived in view of the abovementioned problems. The objects of the invention are to abolish the formation of holes in the timepiece case in order to reduce the job required for the machining operation, to enhance the water-proof feature, and to liberate the designing from restriction even when many external operation members are fitted to the timepiece. According to the invention, the gist resides in that a switch unit made up of an array of a plurality of electric switches is inserted in an external member of a timepiece, and the electric switches are electrically connected to an internal module, and further that, in addition to the abovementioned gist, the external member of the timepiece and the switch unit are engaged with each other preventing the infiltration of water.

Preferred embodiments of this invention are mentioned below in conjunction with the accompanying drawings.

Figure 3:
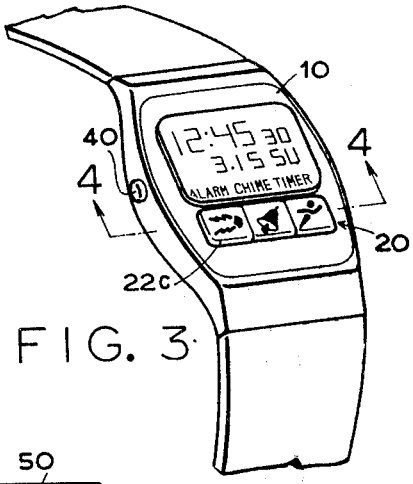
FIG. 3 is a perspective view of an electronic timepiece showing an embodiment according to this invention.
Figure 4:
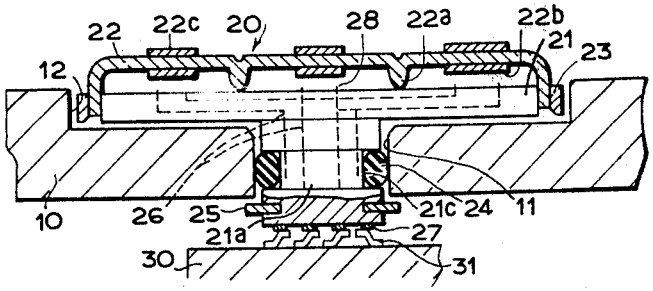
FIG. 4 is a cross-sectional view along a line 4—4 of FIG. 3.

FIGS. 3 and 4 show an embodiment of this invention, in which FIG. 3 is a perspective view of the timepiece, and FIG. 4 is a cross-sectional view along a line 4—4 of FIG. 3.

In the drawings, reference numeral 10 represents a timepiece case, 20 a switch unit made up of an array of a plurality of electric switches, and reference numeral 30 represents a module.

The timepiece case 10 is equipped with a single switch unit 20 on the upper surface and a conventional push button 40 on the side surface. On the upper surface of the timepiece case 10 are provided a stepped portion 12 of a flat and deformed shape and a through hole 11 of the shape of a true circle to accommodate the switch unit 20.

Figure 5:
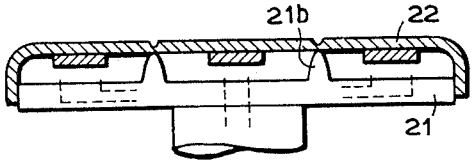
FIG. 5 is a cross-sectional view of another embodiment of the invention.

If roughly mentioned, the switch unit 20 consists of a base body 21, a cover 22 and a metal ring 23, and has a deformed portion on the upper side and a shaft portion on the lower side. The base body 21 is made of a synthetic resin molded by way of injection, and in which are embedded electrically conductive wires 26. Terminals 27 are also provided at the inner end of a shaft portion **21*a* which is downwardly protruded beyond the lower surface of the base body 21. The terminals 27 and the electrically conductive wires 26 are connected together, and the other ends of the electrically conductive wires are exposed on the upper surface of the base body 21 as a plurality sets of terminals 28. Here, the base body 21 may also be made of a rubber or a metal. The cover 22 is made of an elastic material and has projections 22*a* on the inner side. The periphery of the cover 22 comes into contact with the base body 21, and is pressed by means of the metal ring 23 to prevent the infiltration of water. Further, a plurality of electrically conductive rubbers 22*b* integrally adhered onto the lower surface of the cover 22 come into contact with the terminals 28 on the upper surface of the base body 21 when the cover 22 is depressed, thereby to constitute electric switches. The projections 22*a* are provided for the purpose that the neighboring switches are not erroneously closed when the cover 20 is depressed and for the purpose that the cover 20 is restored easily. Hence, the projections 22*a* need not be provided if unnecessary. Further, as shown in FIG. 5, the projections 21*b* may also be protruded on the upper surface of the base body 21. On the upper surface of the cover 22 are described marks or symbols 22*c*** to indicate the contents of the switching function.

As mentioned above, the switch unit 20 consisting of the base body 21 and the cover 22 is fitted with a waterproof packing 24 in a groove **21*c* formed in the periphery of the shaft portion 21*a*, and is inserted in a through hole 11 of the timepiece case 10. Here, the deformed portion of the switch unit 20 is placed on the stepped portion 12 of the timepiece case 10. The base body 21 is fitted with a stop ring 25 so as to be completely attached to the timepiece case 10, and the terminals 27 of the base body 21 come into contact with the contact points 31 of the module 30** to attain electrical connection.

The thus constructed switch will be depressed like the conventional push buttons to attain desired switching functions.

In FIG. 5, the cover 22 and the base body 21 have been secured together by means of adhesion or melt-adhesion instead of using the metal ring.

Figure 6:
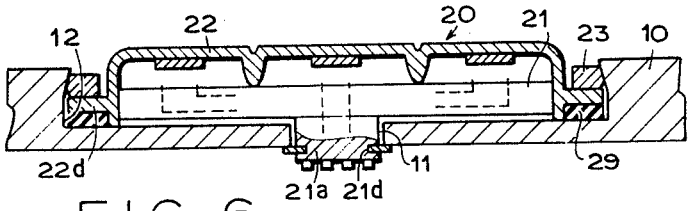
FIG. 6 is a cross-sectional view of another embodiment of this invention.

FIG. 6 shows another embodiment according to this invention, in which parts' numbers are in conformity with the parts' numbers mentioned with reference to FIGS. 3 and 4. The stepped portion 12 of a flat and deformed shape of the timepiece case 10 is tapered in a biting manner so as to engage with the metal ring 23 in a biting manner. The cover 22 has a flange **22*d* which is outwardly protruded, and a water-proof packing 29 is interposed in a compressed manner between the flange 22*d* and the stepped portion 12. Therefore, unlike the abovementioned first embodiment, no groove for disposing the water-proof packing is formed on the circumference of the shaft portion 21***a* of the base body 21, but only a groove 21*d* for holding a stop ring is formed so that the base member is engaged with the timepiece case 10.

According to this embodiment, the infiltration of water is prevented simply by way of the timepiece case 10 and the deformed portion of the switch unit 20, so that the diameter of the through hole 11 can be minimized.

Figure 7:
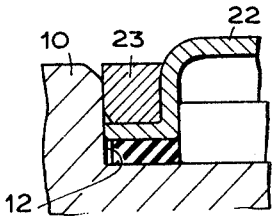
FIGS. 7 to 10 are amplified cross-sectional views in part of other embodiments of this invention respectively.
Figure 8:
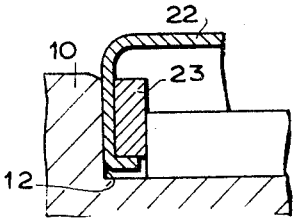
Figure 9:
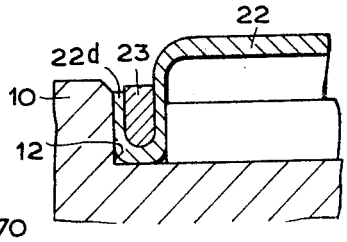

FIG. 7 to FIG. 9 show further embodiments for fastening the cover to the timepiece case preventing the infiltration of water, in which FIG. 7 shows the case when the metal ring 23 is forcibly introduced into the stepped portion 12 of the timepiece case 10, FIG. 8 shows the case when the metal ring 23 is disposed on the inner side of the cover 22, and the cover 22 is forcibly introduced into the stepped portion 12 of the timepiece case 10, and FIG. 9 shows the case when the flange 22*d* of the cover 22 is further extended to form a groove for holding the metal ring 23, the metal ring 23 is inserted thereinto, and the cover 22 is forcibly introduced into the stepped portion 12 of the timepiece case 10.

Figure 10:
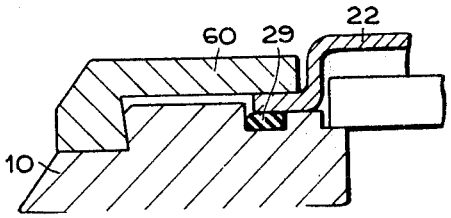

FIG. 10 shows the case in which the flange on the outer circumference of the cover 22 is compressed and fastened by utilizing a member 60 such as the edge or bezel of glass via a water-proof packing 29.

Figure 11:
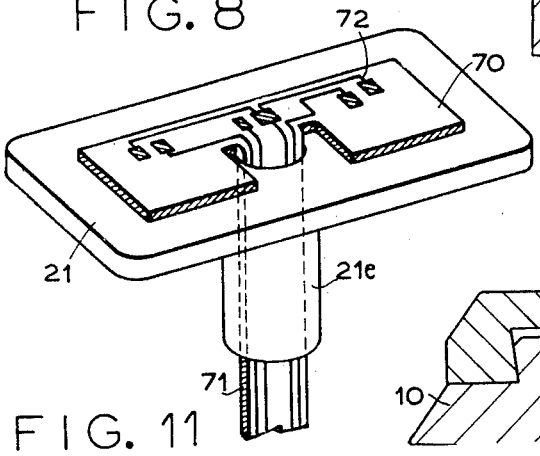
FIG. 11 is a perspective view of a base body of the external operation device of one embodiment according to this invention.

Below is mentioned the base body 21. The base body 21 can be commonly used for the embodiments of this invention diagramatized in FIG. 3 to FIG. 10. In addition to the method of injection-molding shown in FIG. 4 to FIG. 6, the base body may futher be formed, as shown in FIG. 11, by placing a flexible sheet 70 on the upper surface of the base body 21, and inserting a connection portion 71 of the flexible sheet 70 through a hole 21*e* of the base body 21. As a matter of course, the flexible sheet 70 is provided with electrically conductive patterns 72, one ends of which being screwed to the contact points of the module and the other ends of which being brought into contact with the electrically conductive rubbers.

Figure 12:
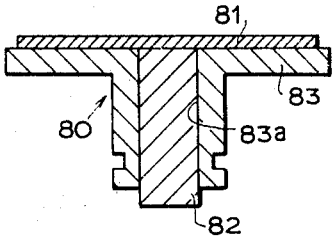
FIG. 12 is a cross-sectional view of a base body showing another embodiment according to this invention.
Figure 13:
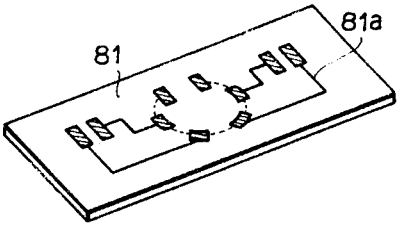
FIG. 13 is a perspective of an electricity distribution panel showing one embodiment according to this invention.
Figure 14:
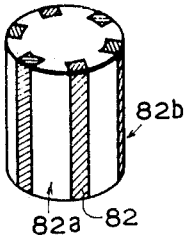
FIG. 14 is a perspective view of an electrically conductive rubber of one embodiment according to this invention.

FIG. 12 to FIG. 14 show the case in which a base body 80 is composed of an electricity distribution panel 81, a cylindrical electrically conductive rubber 82, and a pipelike frame 83, the electricity distribution panel being fastened to the upper surface of the pipe-like frame 83, and the cylindrical electrically conductive rubber 82 being inserted in a hole 83*a* of the pipe-like frame 83. The electricity distribution panel 81 is provided on its upper surface with an electrically conductive pattern 81*a* which is guided to the lower surface through the hole. The electrically conductive rubber 82 is separated by means of nonconductive portions 82*a* to form a plurality of conductive portions 82*b* which will be electrically connected to the electrically conductive pattern 81*a* formed on the electricity distribution panel 81.

The abovementioned embodiments have dealt with the case when the invention is applied to the timepiece case. In view of the gist of the invention, however, the device of this invention can further be applied to the side surfaces of the timepiece case or to the back surfaces of the timepiece case, or even to the strap of the timepieces. Moreover, in addition to the timepiece cases, the device of this invention can further be applied to such external parts as case band, glass edges, glass, back cover, outer case band, inner case band and the like.

Figure 15:
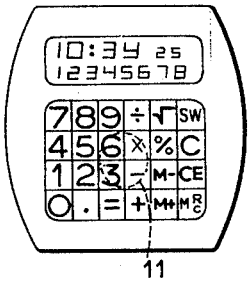
FIG. 15 is a plan view of a timepiece equipped with a calculator to which the construction of this invention is applied.

FIG. 15 shows an embodiment in which the construction according to this invention is applied to a timepiece equipped with a calculator. The timepiece case needs be provided with only one through hole 11 to maintain the water-proof function.

Figure 16:
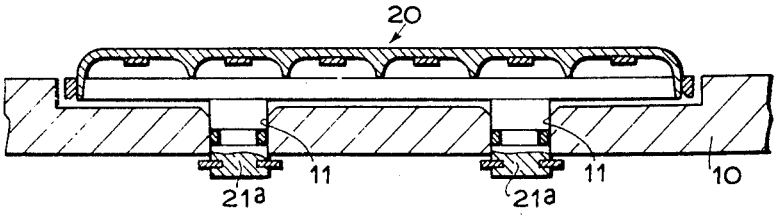
FIG. 16 is a cross-sectional view of an external operation device of a still further embodiment according to this invention.

FIG. 16 shows an embodiment in which the switch unit 20 is provided with two shaft portions 21*a* which are inserted in the two through holes 11 formed in the timepiece case 10.

FIG. 17 shows a modified embodiment of this invention wherein reference numeral 101 denotes a case band of a wrist watch and 102 depicts a module having a recessed portion 103 for accommodating a switching mechanism on an upper side and a hole 104 formed in the bottom. The switching mechanism 105 of this invention will be inserted in the recessed portion and in the hole from an upper direction. The switching mechanism has an insulating base plate 106 made of a plastic material, a push button 107 and a cover 108. On the upper surface of the base plate 106 is adhered a flat insulating plate 109, and onto the flat insulating plate 109 is further adhered an insulating plate 110 made of a resilient material such as polyethylene. The insulating plate 110 has a spherically curved protrusion 111 and the insulating plate 109 has printed wirings.

With reference to an embodiment shown in FIGS. 19 and 20, the insulating plate 110 has spherically curved protrusions 111 at two places, and the insulating plate 109 has printed wirings 113, 114 and 114*a* as shown in FIG. 19. A switching electrode 115 is provided on a recessed wall on a side opposite to the protrusion 111 of the resilient insulating plate 110, and switching electrodes 116 and 117 drawn from the printed wirings 113, 114 and 114*a* are disposed adjacent to each other on the insulating plate 109 opposed to the resilient insulating plate. Other ends 113', 114' and 114*a'* of the printed wirings 113, 114 and 114*a* are exposed to the lower side of the insulating plate 109 penetrating therethrough as shown in FIG. 19, and are pressed by an electrically conductive rubber 118 which penetrates the base plate 106.

The base plate 106 has a flange 120, an O-shaped ring 121 is interposed between the flange 120 and the bottom of the recessed portion 103 of the case band 101, whereby the electrically conductive rubber 118 is brought into pressed contact with an electrode on the module 102 to maintain electrical connection with respect to the switching mechanism. The cover 108 is fitted to the recessed portion 103, and push buttons 107 are brought into contact with upper portions of each of the protrusions 111.

Being constructed as mentioned above, when any one of the push buttons is depressed, the protrusion 111 is compressed and the switching electrode 115 located on the inner side is brought into pressed contact with the electrodes 116 and 117 on the insulating plate 109; electrical connection is attained between the printed wiring 113 and the printed wiring 114, or between the printed wiring 113 and the printed wiring 114*a*. When a finger is removed away from the push button, the protrusion is restored owing to the resilient force so that the connection of the switch is broken.

With reference to an embodiment shown in FIG. 18, a packing 123 is placed on the insulating plate 110 and the lower side of the cover 108 and is secured by means of a ring 122, then the cover 108 is fitted. This setup helps completely keep the electrode portions away from the infiltration of water. The construction is the same as the abovementioned embodiment in regard to other respects and, therefore, the same portions are denoted by the same reference numerals. This embodiment is also capable of attaining the same effects as the abovementioned embodiment.

As will be obvious from the foregoing description, according to this invention, protrusions are formed on the resilient insulating plate, switching electrodes are provided on the side opposite to the protrusions, the protrusions are compressed by means of the push buttons to close the switch, and the electrical connection is broken by the restoring force of the protrusions. Accordingly, the thickness of the switch can be reduced without causing the insulating plate to be extremely folded. It is therefore allowed to provide a switch having increased durability and extended life.

As mentioned above, according to this invention in which a switch unit made up of an array of a plurality of electric switches is inserted in a timepiece case, the manufacturing cost can be greatly reduced as compared with the conventional construction, the timepiece case can be designed in a flexible manner, and many groups of designs can be constituted with a single module. Moreover, since a water-proof packing is interposed between the switch unit and the timepiece case, it is possible to attain a water-proof construction that was impossible with the conventional multi-button mechanism, without causing the manufacturing and technical costs to be increased, thus providing very innovative features.

What is claimed is:

1. An external operation device for electronic timepiece comprising a switch unit composed of a flexible switch cover having an externally actuated surface and a side wall and of a base body having a plate portion and shaft portion and fixed to said flexible switch cover, said externally actuated surface of said flexible switch cover being provided with switch electrodes and protrusions on its lower side, said protrusions partitioning said switch electrodes one from the other, said plate portion of said base body being provided with electrically conductive pattern on its upper surface corresponding to said switch electrodes, said switch unit being fitted through a waterproof packing to a through hole on a timepiece case by means of said shaft portion of said base body, and said electrically conductive pattern being connected to an internal module.

2. The external operation device as claimed in claim 1 further comprising a ring interposed between said timepiece case and said flexible switch cover for fixing said flexible switch cover to said base body.

3. The external operation device as claimed in claim 1 wherein said base body further comprises protrusions partitioning said switch electrodes and said electrically conductive pattern.

4. The external operation device as claimed in claim 1 wherein said flexible switch cover further comprises a flange portion on said side wall thereof.

5. The external operation device as claimed in claim 2 wherein said flexible switch cover further comprises a flange portion on said wall thereof.

6. The external operation device as claimed in claim 1 further comprising a ring interposed between said resilient switch cover and said base body.

7. The external operation device as claimed in claim 1 wherein said flexible switch cover is provided with a rising-up portion of said side wall to which a ring is fitted.

8. The external operation device as claimed in claim 5 wherein said timepiece case has a groove in which a waterproof packing is fitted and said water-proof packing is compressed by another case member through said flange portion.

9. The external operation device as claimed in claim 1 wherein said switch unit further comprises a resilient insulating plate having protrusions, each corresponding to said switch electrode, a plain insulating plate opposite to said resilient insulating plate, a push button arranged opposite to said protrusions, switch electrodes provided on the lower side of said protrusions, opposite electrodes provided on said plain insulating plate in correspondence with said switch electrodes.

10. The external operation device as claimed in claim 7 further comprising a water-proof packing interposed between a plate portion of a base body and a timepiece case band.

11. An external operation device for electronic timepiece comprising:

(a) a switch cover (108) received into a recess of a case band (101) and having a hole of form a flange portion at its inner periphery;

(b) a push button (107) operatively fitted into said hole of said switch cover (108) in such manner that an engaging portion of said push button is engaged with said flange portion of said switch cover (108) at the upmost position of said push button (107);

(c) a resilient insulating plate (111) arranged under said push button (107) within said switch cover (108) and having a protrusion opposed to the bottom of said push button ((107);

(d) a flat insulating plate (109) joined in the lower side of said resilient insulating plate (111) in a superimposed manner;

(e) switching electrodes (115) provided on a recessed wall in a side opposite to said protrusion;

(f) opposed electrodes provided on said flat insulating plate (109) in a manner to be opposed to said switching electrodes (115);

(g) a base plate (106) fitted to the lower side of said flat insulating plate (109) and having a conductive connector which is connected to a module (102) in said timepiece;

(h) a water-proof packing (121) disposed between said case band (101) and said base plate (106); and (i) a retainer (122) disposed between said case band (101) and said base plate (106).

12. The external operation device for timepiece as claimed in claim 11, wherein said opposed electrodes (116) and (117) are drawn from printed wirings (113), (114) and (114*a*) and are disposed adjacent to each other on said flat insulating plate (109) opposed to said resilient insulating plate 111.

13. The external operation device for timepiece as claimed in claim 11 wherein a further packing (123) is placed on said insulating plate (110).

* * * * *

UNITED STATES PATENT AND TRADEMARK OFFICE

CERTIFICATE OF CORRECTION

PATENT NO. : 4,259,551

DATED : March 31, 1981

INVENTOR(S) : Ohtani et al.

It is certified that error appears in the above—identified patent and that said Letters Patent is hereby corrected as shown below:

Column 2, line 27, after "perspective" and before "of", add "view".

Column 5, line 32, "futher" should be "further".

Claim 11, column 8, line 29, "of" should be "to".

Signed and Sealed this

Thirtieth Day of June 1981

[SEAL]

Attest:

RENE D. TEGTMEYER

Attesting Officer

Acting Commissioner of Patents and Trademarks